US009523171B2

(12) United States Patent
Cho et al.

(10) Patent No.: US 9,523,171 B2
(45) Date of Patent: Dec. 20, 2016

(54) BALANCER AND WASHING MACHINE HAVING THE SAME

(71) Applicant: SAMSUNG ELECTRONICS CO., LTD., Suwon-si, Gyeonggi-do (KR)

(72) Inventors: Young Jin Cho, Seongnam-si (KR); Doo Young Ryu, Suwon-si (KR); Won Young Jung, Seoul (KR); Jeong Hoon Kang, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 327 days.

(21) Appl. No.: 14/163,347

(22) Filed: Jan. 24, 2014

(65) Prior Publication Data

US 2014/0208807 A1 Jul. 31, 2014

(30) Foreign Application Priority Data

Jan. 25, 2013 (KR) ..... 10-2013-0008913
Jul. 17, 2013 (KR) ..... 10-2013-0084410

(51) Int. Cl.
*D06F 37/22* (2006.01)
*D06F 37/24* (2006.01)

(52) U.S. Cl.
CPC ..... *D06F 37/225* (2013.01); *D06F 37/22* (2013.01); *D06F 37/245* (2013.01)

(58) Field of Classification Search
CPC ..... D06F 37/22; D06F 37/225; F16F 15/363
See application file for complete search history.

(56) References Cited

U.S. PATENT DOCUMENTS

2001/0038601 A1* 11/2001 Kikuchi ..... F16F 15/363 720/701
2012/0084926 A1* 4/2012 Lee ..... D06F 37/225 8/137
2012/0192362 A1* 8/2012 Lee ..... D06F 37/203 8/137

FOREIGN PATENT DOCUMENTS

EP 2 441 872 5/2011
GB 2410750 A * 8/2005 ..... D06F 37/225
KR 10-2008-0037428 4/2008

OTHER PUBLICATIONS

Extended European Search Report issued Aug. 4, 2014 in corresponding European Patent Application No. 14152539.4.
European Decision on Grant dated Jul. 29, 2016 from European Patent Application No. 14152539.4, 44 pages.

* cited by examiner

*Primary Examiner* — Joseph L Perrin
(74) *Attorney, Agent, or Firm* — Staas & Halsey LLP

(57) ABSTRACT

A washing machine having a balancer to offset unbalanced load generated during rotation of a drum. The washing machine includes a cabinet, a drum rotatably disposed in the cabinet, and a balancer mounted to the drum to offset unbalanced load generated in the drum during rotation of the drum. The balancer includes a balancer housing having an annular channel defined therein, at least one mass movably disposed in the channel, a magnet provided at one side of the balancer housing to restrain the mass, and a magnet case to receive the magnet.

16 Claims, 19 Drawing Sheets

BALANCER AND WASHING MACHINE HAVING THE SAME

CROSS-REFERENCE TO RELATED APPLICATIONS

This application claims the benefit of Korean Patent Application Nos. 10-2013-0008913 and 10-2013-0084410, filed on Jan. 25 and Jul. 17, 2013, respectively, in the Korean Intellectual Property Office, the disclosures of which are incorporated herein by reference.

BACKGROUND

1. Field

Embodiments of the present disclosure relate to a washing machine having a balancer to offset unbalanced load generated during rotation of a drum.

2. Description of the Related Art

A washing machine is a machine that washes clothes using electric power. Generally, the washing machine includes a cabinet forming the external appearance of the washing machine, a tub to contain wash water in the cabinet, a drum rotatably mounted in the tub, and a motor to rotate the drum.

When the drum is rotated by the motor in a state in which laundry is put in the drum together with detergent water, contaminants are removed from the laundry by friction between the laundry and the drum and between the laundry and wash water.

If the laundry is not uniformly distributed in the drum but accumulates at one side during rotation of the drum, vibration and noise are generated due to eccentric rotation of the drum. According to circumstances, parts, such as the drum or the motor, of the washing machine may be damaged.

For this reason, the washing machine has a balancer that offsets unbalanced load generated in the drum to stabilize rotation of the drum.

SUMMARY

It is an aspect of the present disclosure to provide a balancer which exhibits improved performance, is assembled with improved work efficiency, and maximally secures the capacity of a drum and a washing machine having the same.

Additional aspects of the disclosure will be set forth in part in the description which follows and, in part, will be apparent from the description, or may be learned by practice of the disclosure.

In accordance with one aspect of the present disclosure, a washing machine includes a cabinet, a drum rotatably disposed in the cabinet, and a balancer mounted to the drum to offset unbalanced load generated in the drum during rotation of the drum, wherein the balancer includes a balancer housing having an annular channel defined therein, at least one mass movably disposed in the channel, a magnet provided at one side of the balancer housing to restrain the mass, and a magnet case to receive the magnet.

The magnet case may be coupled to a rear surface of the balancer housing in a state in which the magnet is received in the magnet case.

The magnet case may cover one major surface of the magnet and expose the other major surface of the magnet.

The other major surface of the magnet exposed from the magnet case may be opposite the drum toward a rear of the balancer housing.

The other major surface of the magnet exposed from the magnet case may be opposite the rear surface of the balancer housing.

The magnet may be disposed in a circumferential direction of the balancer housing to restrain the mass when the number of rotations per minute of the drum is within a predetermined range.

The magnet case may be provided with a plurality of support protrusions to prevent the magnet from being separated from the magnet case.

The magnet may be provided with a stepped part, which is supported by the support protrusions.

The magnet case may be fixed to a rear surface of the balancer housing by thermal welding in a state in which the magnet is received in the magnet case.

The magnet may include a plurality of magnets, which are received in the magnet case.

The magnet may be coupled to the magnet case by insert injection.

The drum may be provided with an annular recess, in which the balancer is mounted.

A damping fluid to push the mass when force is applied to the mass may be contained in the channel.

In accordance with another aspect of the present disclosure, a balancer of a washing machine to offset unbalanced load present in a drum of the washing machine includes a balancer housing mounted to at least one selected from a front surface and a rear surface of the drum, the balancer housing having a channel extending in a circumferential direction of the drum, a plurality of masses movably disposed in the channel, a magnet formed at an inner surface of the balancer housing to restrain the masses when the number of rotations per minute of the drum is within a predetermined range, and a magnet case to receive the magnet.

The magnet case may be provided at one side thereof with a support protrusion to prevent the magnet from being separated from the magnet case.

The magnet may be provided with a stepped part, which is supported by the support protrusion.

The magnet may be coupled to the magnet case by insert injection.

The magnet case may be provided at one side thereof with an opening, through which a portion of the magnet received in the magnet case is exposed.

The magnet may include a plurality of magnets, which are received in the magnet case.

The magnet case may be fixed to a rear surface of the balancer housing in a state in which the magnet is received in the magnet case.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
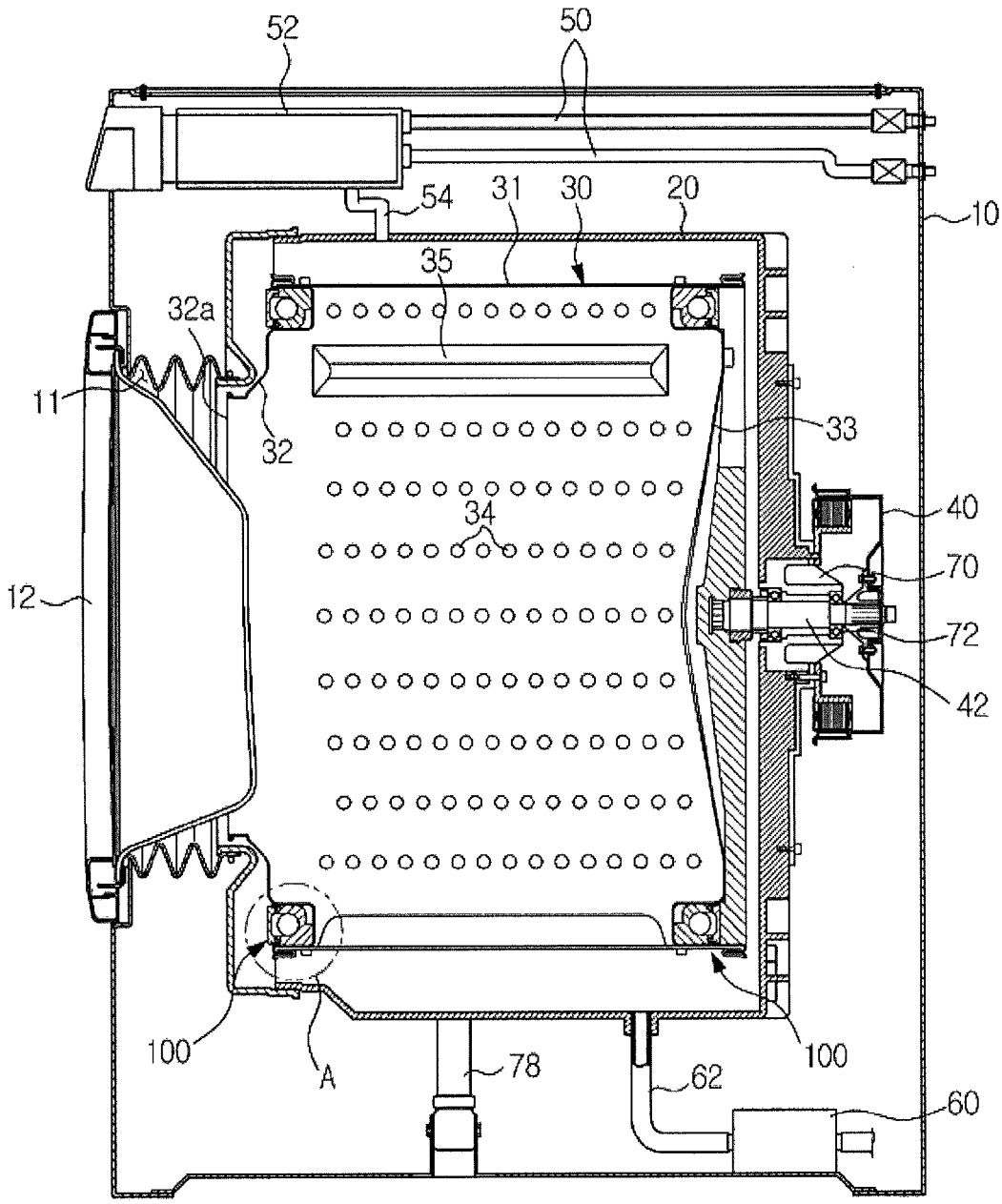
FIG. 1 is a view showing construction of a washing machine according to an embodiment of the present disclosure.

Reference will now be made in detail to the embodiments, examples of which are illustrated in the accompanying drawings, wherein like reference numerals refer to the like elements throughout. The embodiments are described below to explain the present disclosure by referring to the figures.

FIG. 1 is a view showing the construction of a washing machine according to an embodiment of the present disclosure.

As shown in FIG. 1, a washing machine 1 includes a cabinet 10 forming the external appearance thereof, a tub 20 disposed in the cabinet 10, a drum 30 rotatably disposed in the tub 20, and a motor 40 to drive the drum 30.

An introduction port 11, through which laundry is introduced into the drum 30, is formed at the front of the cabinet 10. The introduction port 11 is opened and closed by a door 12 mounted at the front part of the cabinet 10.

Above the tub 20 is mounted a water supply pipe 50 to supply wash water to the tub 20. One side of the water supply pipe 50 is connected to a water supply valve 56 and the other side of the water supply pipe 50 is connected to a detergent supply unit 52.

The detergent supply unit 52 is connected to the tub 20 via a connection pipe 54. Water, supplied through the water supply pipe 50, is supplied into the tub 20 together with detergent via the detergent supply unit 52.

Under the tub 20 are provided a drainage pump 60 and a drainage pipe 62 to discharge water in the tub 20 from the cabinet 10.

The drum 30 includes a cylinder part 31, a front plate 32 disposed at the front of the cylinder part 31, and a rear plate 33 disposed at the rear of the cylinder part 31. An opening 32*a*, through which laundry is introduced and removed, is formed at the front plate 32. A drive shaft 42 to transmit power from the motor 40 to the drum 30 is connected to the rear plate 33.

The drum 30 is provided at the circumference thereof with a plurality of through holes 34, through which wash water flows. The drum 30 is provided at the inner circumference thereof with a plurality of lifters 35, by which laundry is raised and dropped when the drum 30 is rotated.

The drive shaft 42 is disposed between the drum 30 and the motor 40. One end of the drive shaft 42 is connected to the rear plate 33 of the drum 30 and the other end of the drive shaft 42 extends to the outside of the rear wall of the tub 20. When the drive shaft 42 is driven by the motor 40, the drum 30 connected to the drive shaft 42 is rotated about the drive shaft 42.

At the rear wall of the tub 20 is mounted a bearing housing 70 to rotatably support the drive shaft 42. The bearing housing 70 may be made of an aluminum alloy. The bearing housing 70 may be inserted into the rear wall of the tub 20 when the tub 20 is injection molded. Between the bearing housing 70 and the drive shaft 42 are mounted bearings 72 to smoothly rotate the drive shaft 42.

The tub 20 is supported by a damper 78. The damper 78 is connected between the inside bottom of the cabinet 10 and the outer surface of the tub 20.

During a washing cycle, the motor 40 rotates the drum 30 in alternating directions at low speed. As a result, laundry in the drum 30 is repeatedly raised and dropped so that contaminants are removed from the laundry.

During a spin-drying cycle, the motor 40 rotates the drum 30 in one direction at high speed. As a result, water is separated from laundry by centrifugal force applied to the laundry.

If the laundry is not uniformly distributed in the drum 30 but accumulates at one side when the drum 30 is rotated during spin-drying, rotation of the drum 30 is unstable, generating vibration and noise.

For this reason, the washing machine 1 includes a balancer 100 to stabilize rotation of the drum 30.

Figure 2:
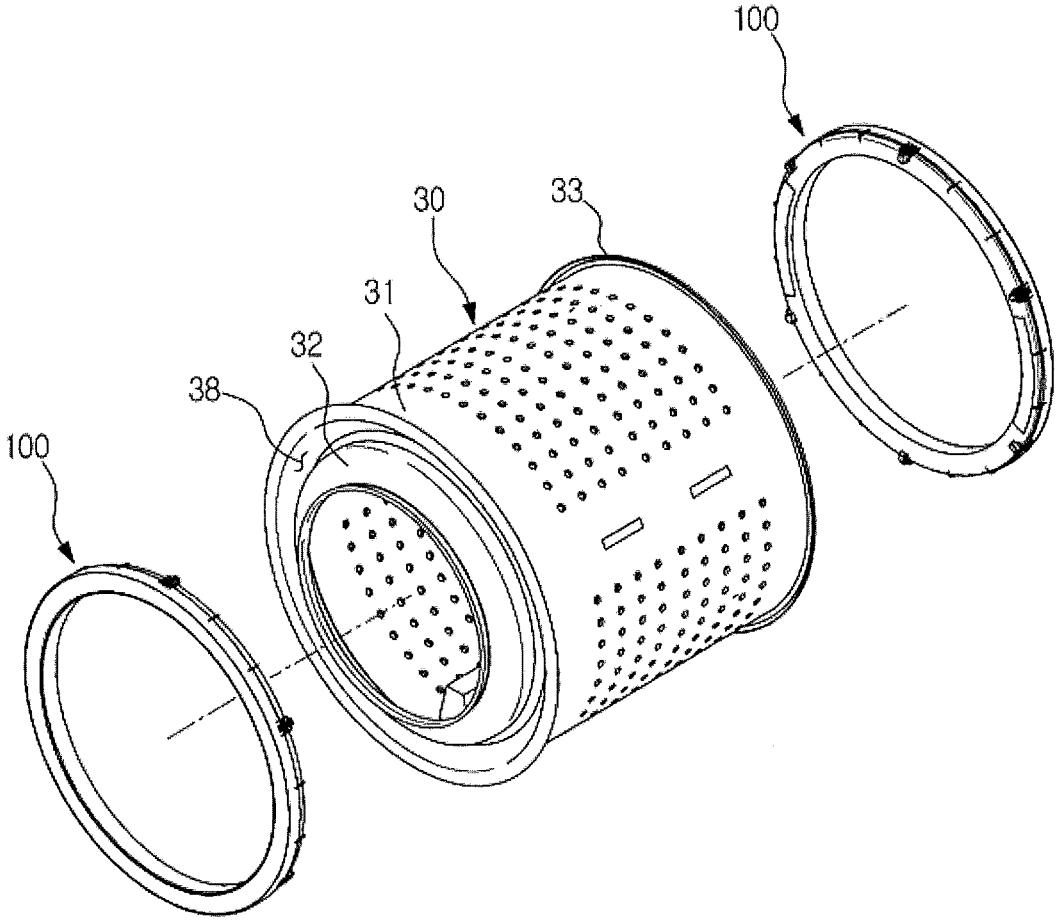
FIG. 2 is an exploded perspective view showing a drum and a balancer according to an embodiment of the present disclosure.
Figure 3:
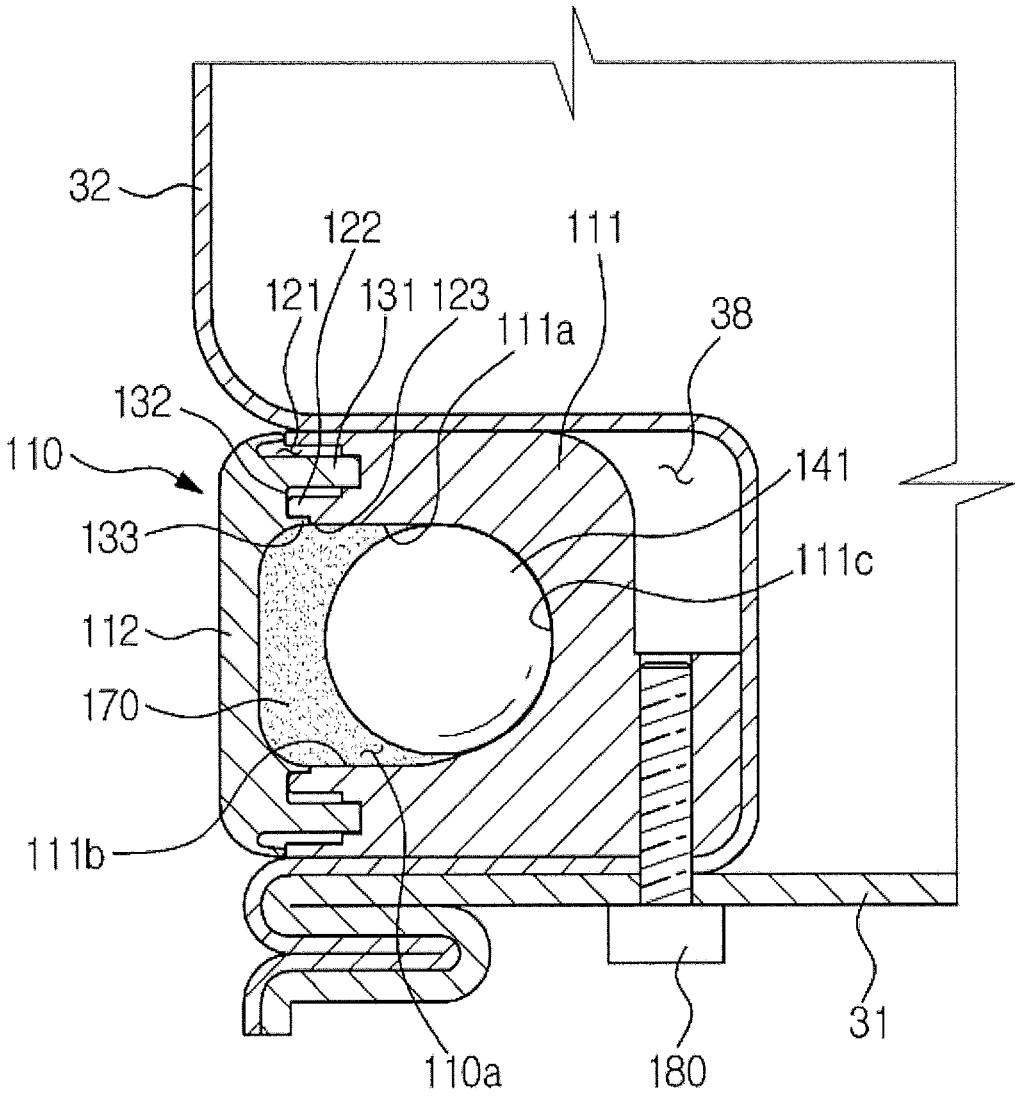
FIG. 3 is an enlarged view showing part A of FIG. 1.
Figure 4:
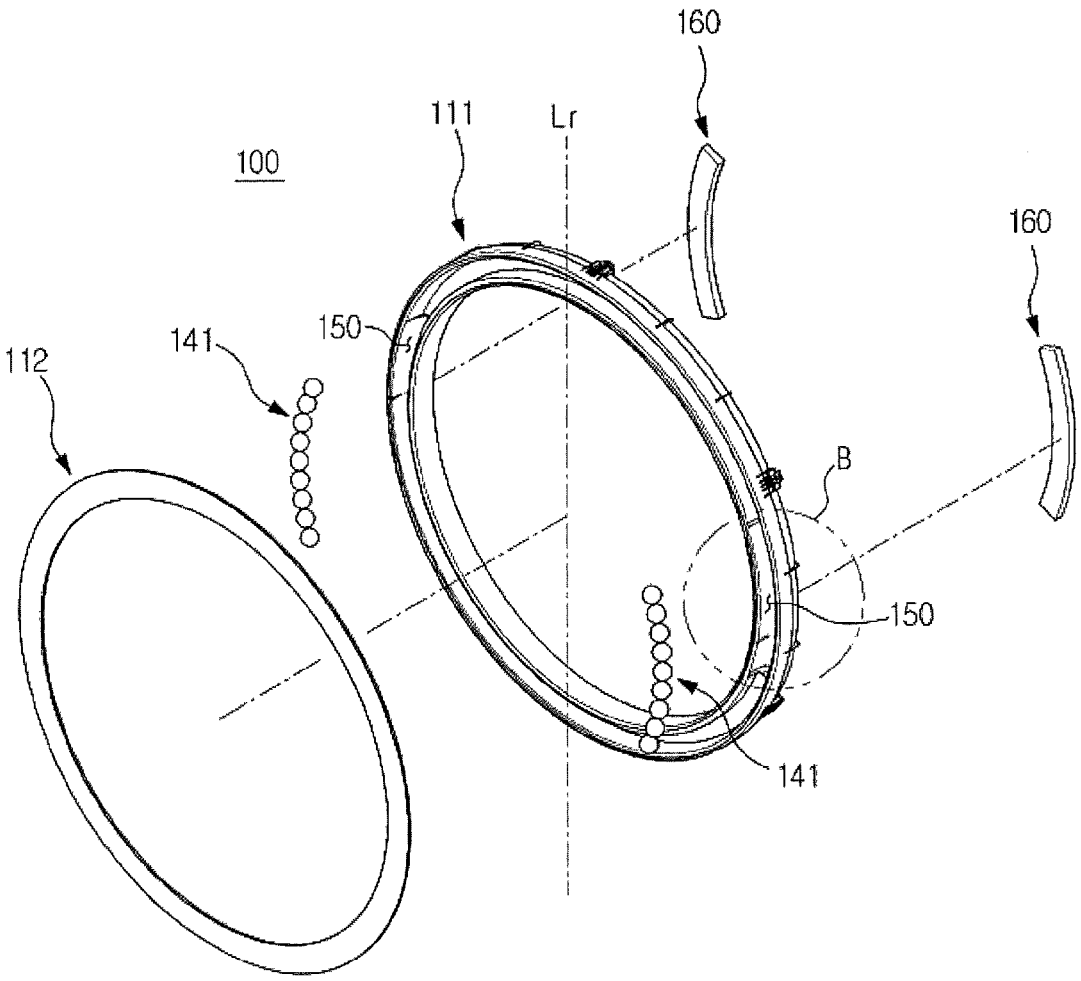
FIG. 4 is an exploded perspective view of the balancer shown in FIG. 2.
Figure 5:
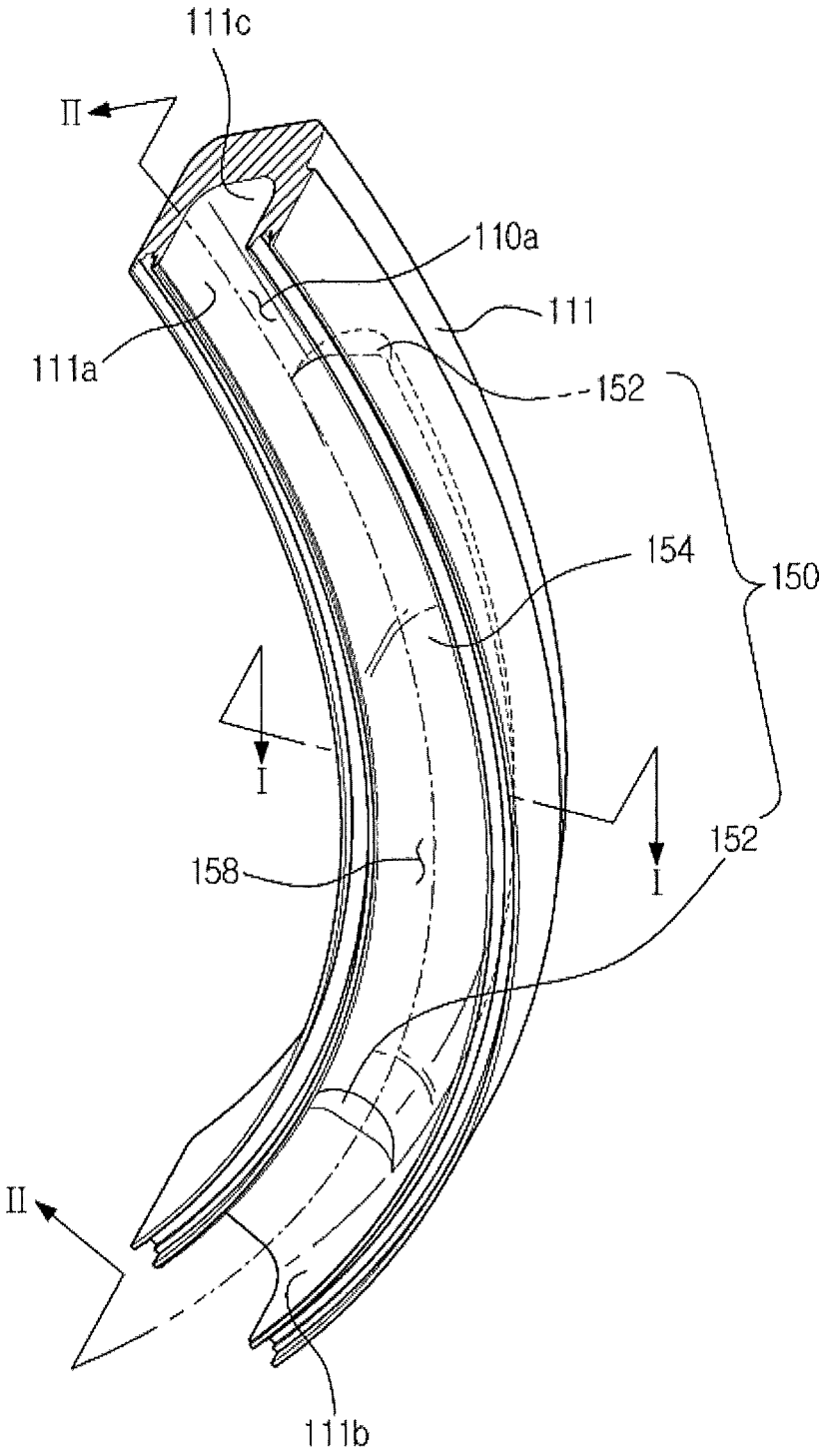
FIG. 5 is an enlarged view showing part B of FIG. 4.
Figure 6:
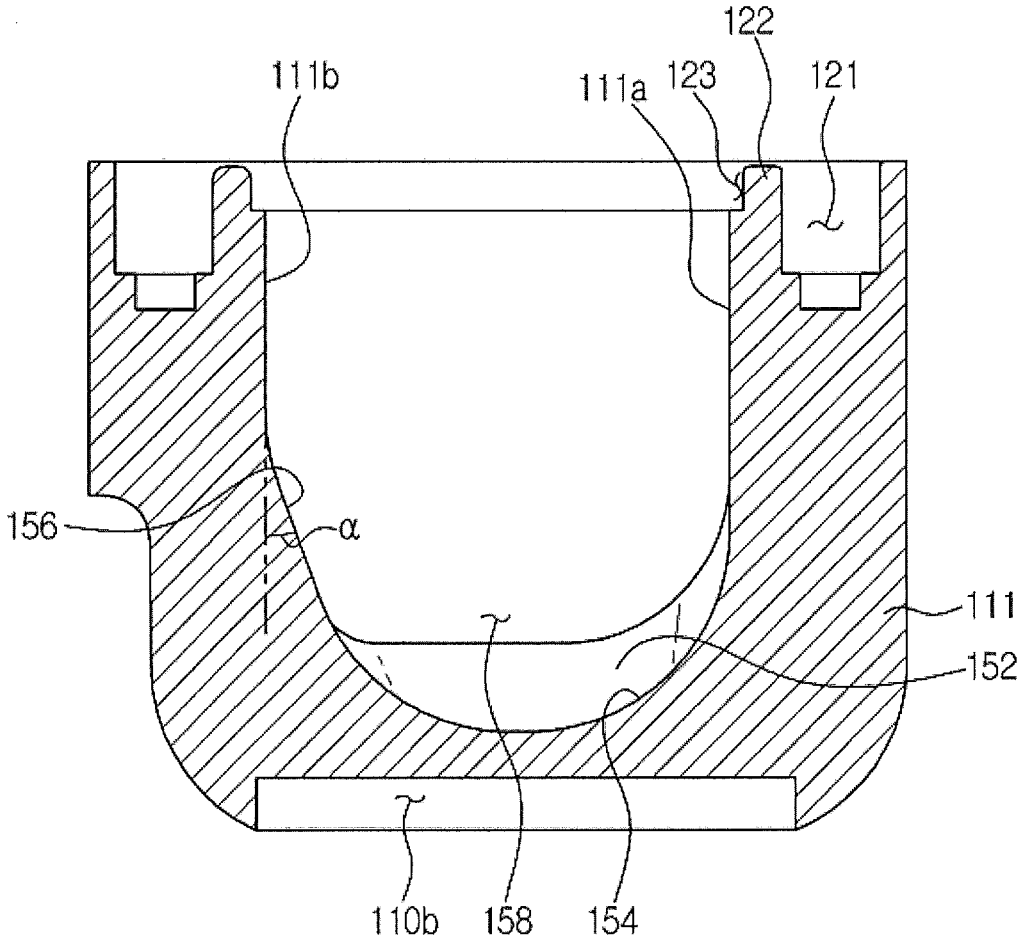
FIG. 6 is a sectional view taken along line I-I of FIG. 5.
Figure 7:
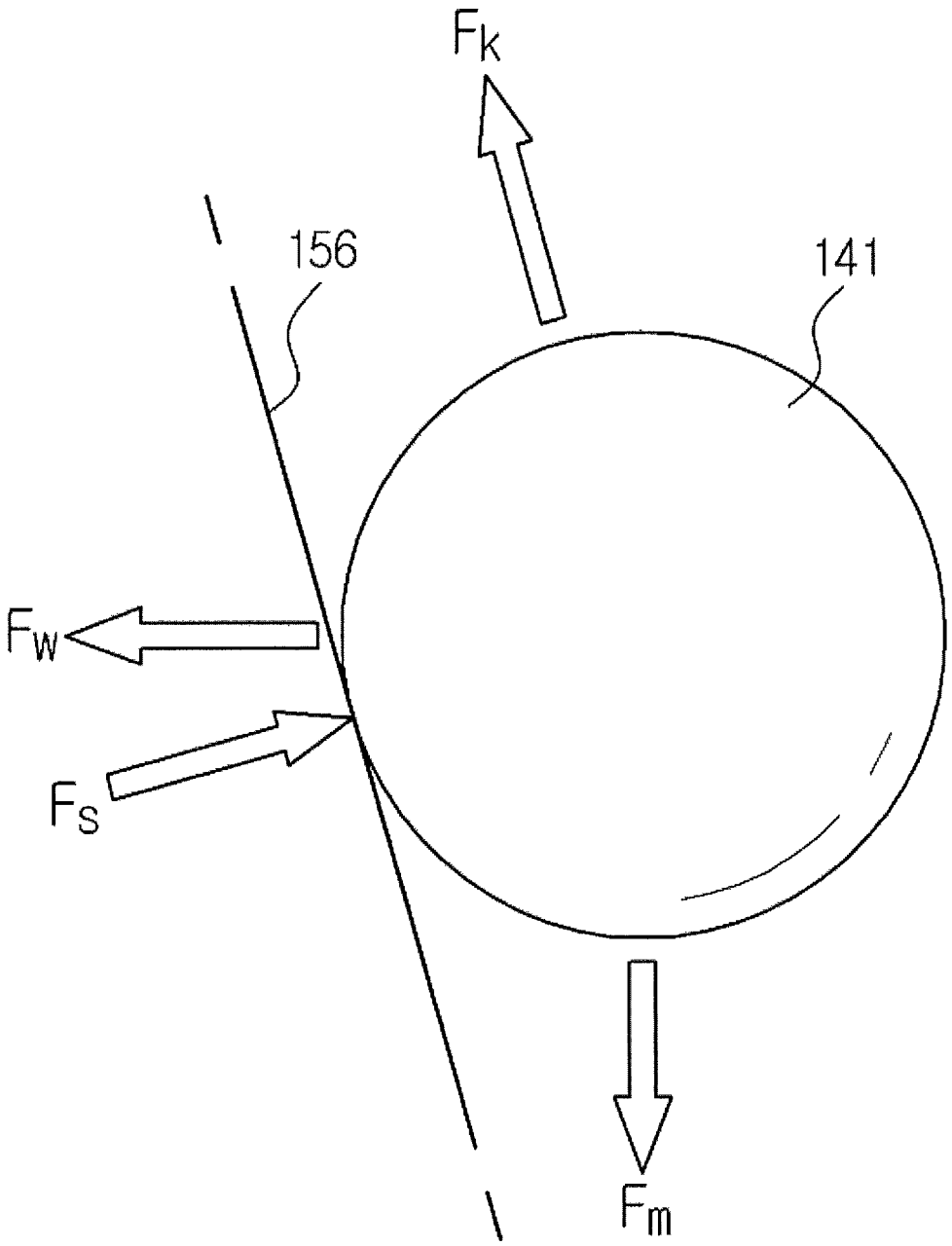
FIG. 7 is a view illustrating a relationship among centrifugal force, magnetic force, and supporting force generated by an inclined sidewall.
Figure 8:
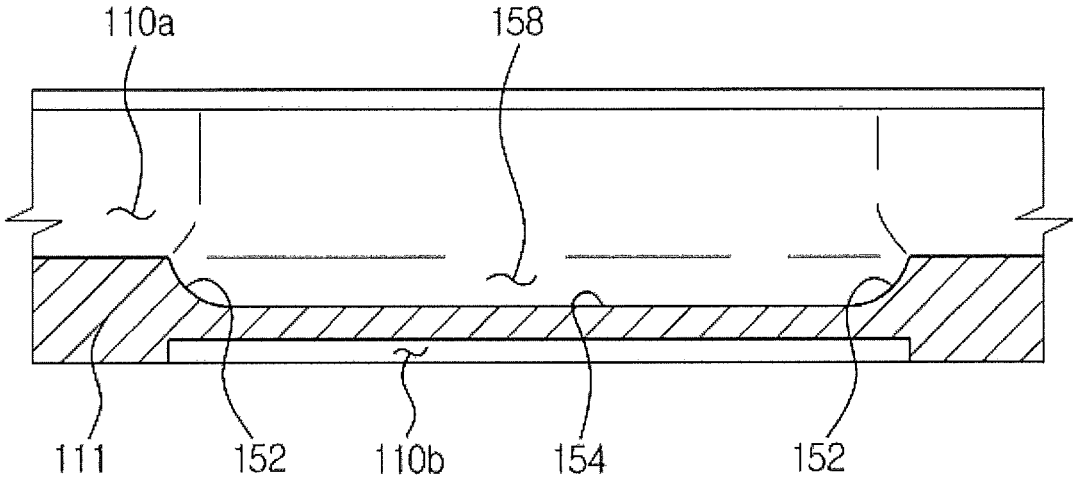
FIG. 8 is a sectional view taken along line II-II of FIG. 5.

FIG. 2 is an exploded perspective view showing a drum and a balancer according to an embodiment of the present disclosure and FIG. 3 is an enlarged view showing part A of FIG. 1. FIG. 4 is an exploded perspective view of the balancer shown in FIG. 2 and FIG. 5 is an enlarged view showing part B of FIG. 4. FIG. 6 is a sectional view taken along line I-I of FIG. 5. FIG. 7 is a view illustrating a relationship among centrifugal force, magnetic force, and supporting force generated by an inclined sidewall. FIG. 8 is a sectional view taken along line II-II of FIG. 5.

The balancer 100 may be mounted to the front plate 32 and/or the rear plate 33 of the drum 30. The balancer 100 mounted to the front plate 32 and the balancer 100 mounted to the rear plate 33 are the same. Hereinafter, therefore, a description will be given of the balancer 100 mounted to the front plate 32.

As shown in FIGS. 1 to 8, the balancer 100 includes a balancer housing 110 having an annular channel 110*a* and a plurality of masses 141 disposed in the annular channel 110*a* such that the masses 141 move along the annular channel 110*a* to perform a balancing function of the drum 30.

An annular recess 38, which is open at the front thereof, is formed at the front plate 32 of the drum 30. The balancer housing 110 is received in the recess 38. The balancer housing 110 may be coupled to the drum 30 by fixing members 180 such that the balancer housing 110 is securely fixed to the drum 30.

The balancer housing 110 includes a first annular housing 111 opened at one side thereof and a second housing 112 to cover the opening of the first housing 111. The inner surface of the first housing 111 and the inner surface of the second housing 112 define the annular channel 110*a*. The first housing 111 and the second housing 112 may be manufactured by injection molding of plastic, such as polypropylene (PP) or acrylonitrile butadiene styrene (ABS). In addition, the first housing 111 and the second housing 112 may be thermally welded to each other. In the following, the front surface of the balancer housing 110 is defined as a surface exposed forward when the balancer housing 110 is coupled to the drum 30 and the rear surface of the balancer housing 110, which is opposite to the front surface of the balancer housing 110, is defined as a surface facing the front plate 32 of the drum 30 when the balancer housing 110 is coupled to the drum 30. In addition, the side surface of the balancer housing 110 is defined as a surface connected between the front surface and the rear surface of the balancer housing 110.

The first housing 111 has first coupling grooves 121 formed at opposite sides of the channel 110*a* and the second housing 112 has first coupling protrusions 131 coupled in the first coupling grooves 121. Second coupling protrusions 122 are formed between the first coupling grooves 121 of the first housing 111 and the channel 110*a*. The second coupling protrusions 122 of the first housing 111 are coupled in second coupling grooves 132 formed at the insides of the first coupling protrusions 131 of the second housing 112. Third coupling grooves 123 are formed at the insides of the second coupling protrusions 122 adjacent to the channel 110*a* and the second housing 112 has third coupling protrusions 133 coupled in the third coupling grooves 123. In the above coupling structure, the first housing 111 and the second housing 112 may be securely coupled to each other and, in a case in which a fluid, such as oil, is contained in the channel 110*a*, leakage of the fluid may be prevented.

The first housing 111 includes a first inner surface 111*a* and a second inner surface 111*b*, which are opposite each other and a third inner surface 111*c* connected between the first inner surface 111*a* and the second inner surface 111*b*.

At least one selected from among the first inner surface 111*a*, the second inner surface 111*b*, and the third inner surface 111*c* is provided with a groove 150, in which the masses 141 are located such that the masses 141 are temporarily restrained. In FIGS. 2 to 8, the groove 150 is formed in the first inner surface 111*a* and the third inner surface 111*c*. However, embodiments of the present disclosure are not limited thereto. For example, the groove 150 may be formed in any one selected from among the first inner surface 111*a*, the second inner surface 111*b*, and the third inner surface 111*c*, in the first inner surface 111*a* and the third inner surface 111*c*, or in the first inner surface 111*a*, the second inner surface 111*b*, and the third inner surface 111*c*.

The groove 150 extends in a circumferential direction of the balancer housing 110 to receive at least two masses 141. The groove 150 includes first support parts 152 to support the masses 141 approximately in the circumferential direction and a radial direction of the balancer housing 110 and a second support part 154 provided between the first support parts 152 to support the masses 141 approximately in the radial direction of the balancer housing 110. The first support parts 152 are provided at the opposite ends of the groove 150 in the form of a step projection to prevent the masses 141 from being separated from the groove 150 when the number of rotations of the drum 30 is within a predetermined range.

In addition, in order to prevent unbalanced load from being generated in the drum 30 due to the masses 141 in a state in which the masses 141 are located in each groove 150, grooves 150 may be disposed symmetrically with respect to a virtual line Lr passing through a center of rotation of the drum 30 and perpendicular to the ground.

An inclined sidewall 156 is provided at the second inner surface 111*b* corresponding to the first inner surface 111*a* in which the groove 150 is formed. As shown in FIG. 7, the inclined sidewall 156 generates supporting force Fs to support the mass 141 in a direction resisting centrifugal force Fw applied to the mass 141 during rotation of the drum 30. Consequently, the centrifugal force Fw applied to the mass 141 during rotation of the drum 30 is offset by the supporting force Fs of the inclined sidewall 156 applied to the mass 141. As will hereinafter be described, therefore, magnetic force Fm generated by the magnet 160 coupled to the rear surface of the balancer housing 110 offsets only force Fk of the mass 141 formed along the inclined sidewall 156 such that the movement of the mass 141 is restrained when the number of rotations of the drum 30 is within a predetermined range. As described above, the inclined sidewall 156 is provided at the second inner surface 111*b* corresponding to the first inner surface 111*a* in which the groove 150 is formed such that the centrifugal force Fw applied to the mass 141 during rotation of the drum 30 is offset by the inclined sidewall 156. Consequently, the movement of the mass 141 is effectively restrained and controlled even using magnetic force Fm having low intensity.

The inclined sidewall 156 may have an inclination angle $\alpha$ of about 5 to 25 degrees. Although not shown, the inclination angle $\alpha$ of the inclined sidewall 156 may be changed in the inner circumferential direction of the balancer housing 110. That is, the inclination angle $\alpha$ of the inclined sidewall 156 may be maintained at 5 degrees in a section of the inclined sidewall 156 and the inclination angle $\alpha$ of the inclined sidewall 156 may be maintained at an angle greater than 5 degrees or less than 25 degrees in another section of the inclined sidewall 156. In addition, the inclination angle $\alpha$ of the inclined sidewall 156 may be successively increased or decreased in the inner circumferential direction of the balancer housing 110. As described above, the inclination angle $\alpha$ of the inclined sidewall 156 is changed in the inner circumferential direction of the balancer housing 110, thereby preventing the masses 141 received in the groove 150 from sticking to the groove 150.

The channel 110*a* includes a section increase portion 158 formed at a region thereof where the groove 150 is formed. The section increase portion 158 is a space defined in the channel 110*a* by the groove 150. The section increase portion 158 is formed in a shape corresponding to at least a portion of the mass 141. In the same manner as in the groove 150, each section increase portion 158 may extend in the circumferential direction of the balancer housing 110 to receive at least two masses 141 and section increase portions 158 may be disposed symmetrically with respect to a virtual line Lr passing through a center of rotation of the drum 30.

Each mass 141 is formed of a metal material having a spherical shape. The masses 141 are movably disposed along the annular channel 110*a* in the circumferential direction of the drum 30 to offset unbalanced load in the drum 30 during rotation of the drum 30. When the drum 30 is rotated, centrifugal force is applied to the masses 141 in a direction in which the radius of the drum 30 is increased and the masses 141, separated from the groove 150, move along the channel 110*a* to perform a balancing function of the drum 30.

The masses 141 are received in the first housing 111 before the first housing 111 and the second housing 112 are welded to each other. The masses 141 may be disposed in the balancer housing 110 by welding the first housing 111 and the second housing 112 to each other in a state in which the masses 141 are received in the first housing 111.

A damping fluid 170 to prevent abrupt movement of the masses 141 is contained in the balancer housing 110.

The damping fluid 170 applies resistance to the masses 141 when force is applied to the masses 141 to prevent the masses 141 from abruptly moving in the channel 110*a*. The damping fluid 170 may be oil. The damping fluid 170 partially performs a balancing function of the drum 30 together with the masses 141 during rotation of the drum 30.

The damping fluid 170 is injected into the first housing 111 together with the masses 141 and is received in the balancer housing 110 by welding the first housing 111 and the second housing 112 to each other. However, embodiments of the present disclosure are not limited thereto. For example, the first housing 111 and the second housing 112 may be welded to each other and then the damping fluid 170 may be injected into the balancer housing 110 through an injection port (not shown) formed at the first housing 111 or the second housing 112 such that the damping fluid 170 is received in the balancer housing 110.

At least one magnet 160 to restrain the masses 141 together with the groove 150 is coupled to the rear surface of the balancer housing 110.

Figure 9:
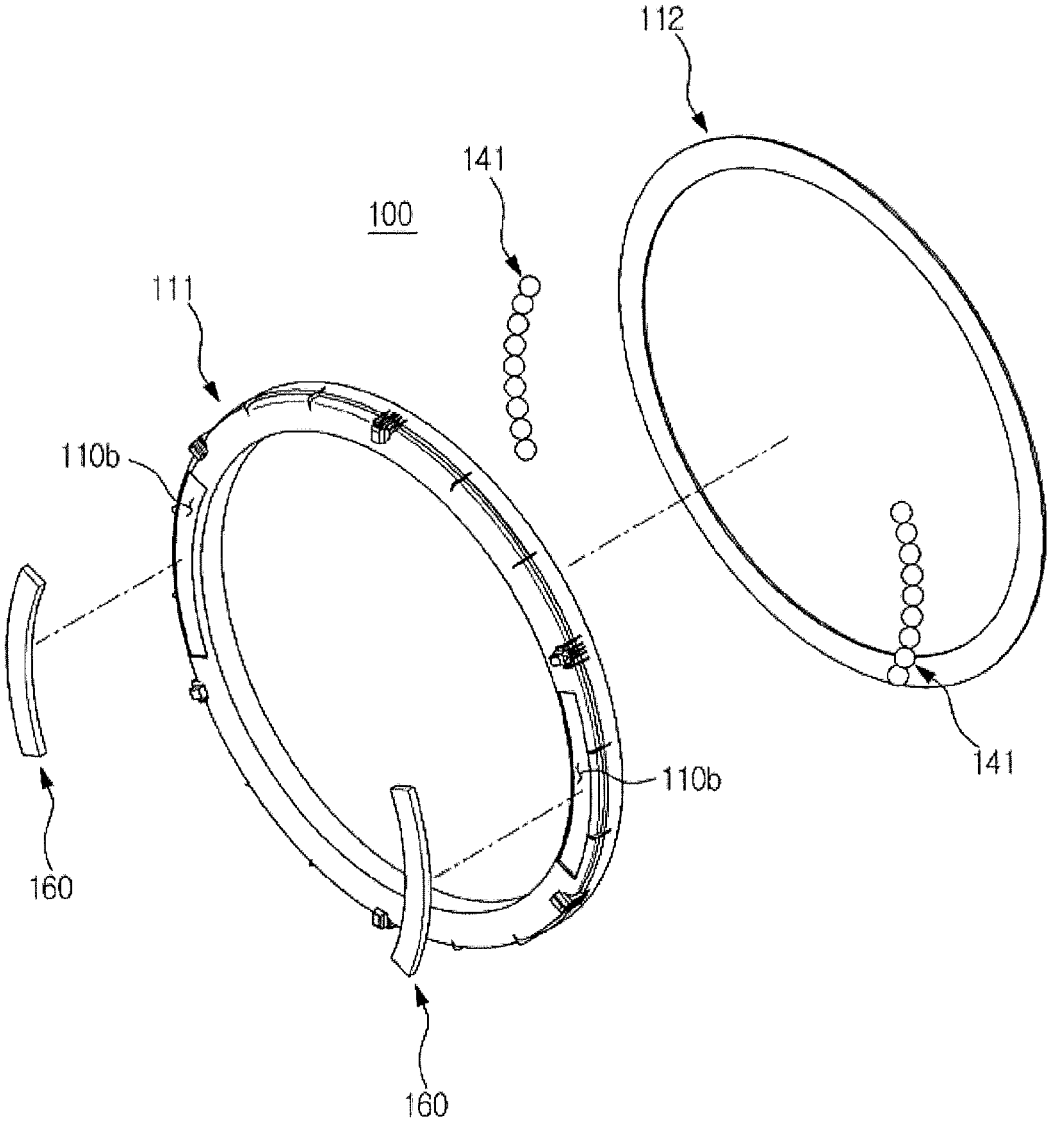
FIG. 9 is an exploded perspective view of FIG. 4 when viewed from another angle.
Figure 10:
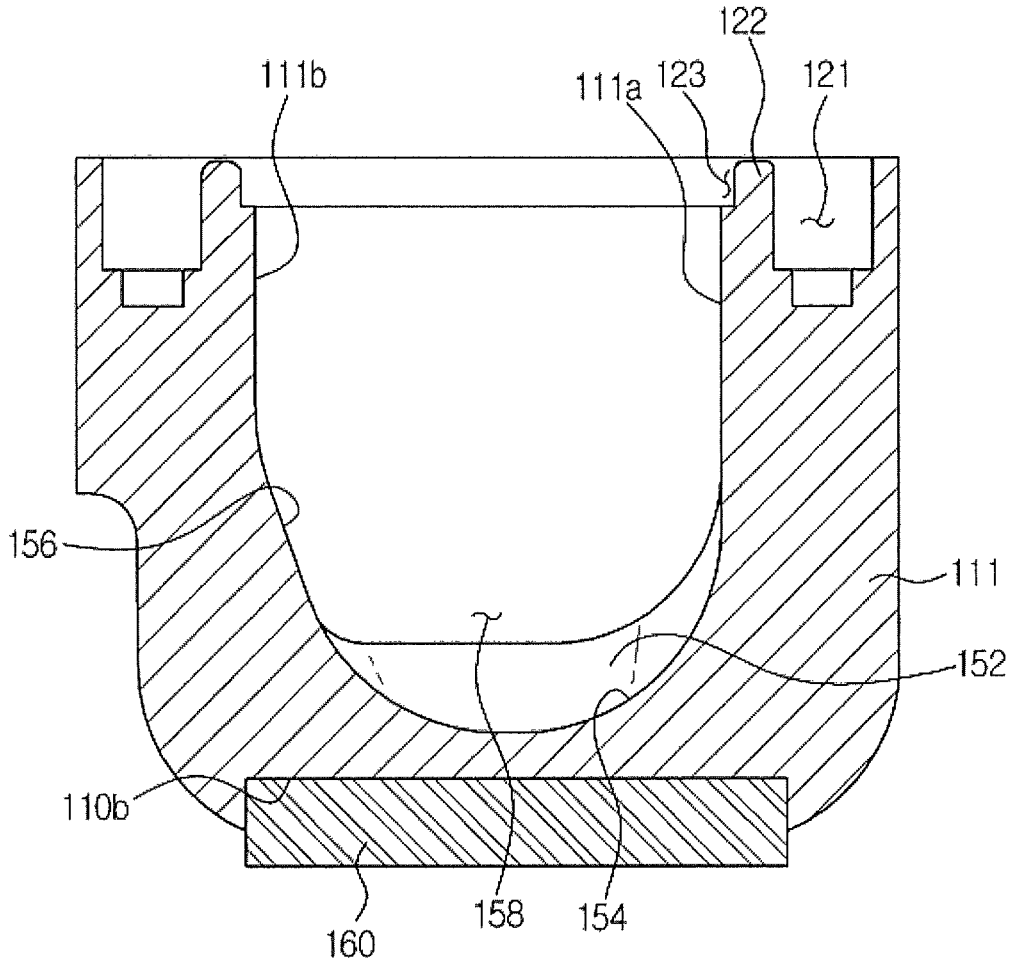
FIG. 10 is a view showing a coupling structure between a balancer housing and a magnet according to an embodiment of the present disclosure.

FIG. 9 is an exploded perspective view of FIG. 4 when viewed from another angle and FIG. 10 is a view showing a coupling structure between the balancer housing and the magnet according to an embodiment of the present disclosure.

As shown in FIGS. 9 and 10, the balancer housing 110 is provided at the rear surface thereof corresponding to the inner surface of the balancer housing 110, at which the groove 150 is formed, with a magnet receiving groove 110*b* to receive a magnet such that the magnet is coupled to the magnet receiving groove 110*b*. The magnet receiving groove 110*b* may be formed in a shape corresponding to the magnet 160 such that the magnet 160 is coupled to the magnet receiving groove 110*b*.

The magnet 160 is formed approximately in a rectangular shape and is coupled to the rear surface of the balancer housing 110 to restrain at least one mass 141 received in the groove 150 such that the mass 141 is not separated from the groove 150. The magnet 160 may be fixed in the magnet receiving groove 110*b* by force fitting or using an additional coupling material.

The magnet 160 is not necessarily coupled to the rear surface of the balancer housing 110. The magnet 160 may be coupled to the front surface of the balancer housing 110 or to the side surface of the balancer housing 110 connected between the front surface and the rear surface of the balancer housing 110.

The magnet 160 restrains the mass 141 using magnetic force. Intensity of the magnetic force generated by the magnet 160 is decided based on the number of rotations per minute of the drum 30 when the mass 141 is separated from the groove 150. For example, in order to set the number of rotations per minute of the drum 30 when the mass 141 is separated from the groove 150 to 200 rpm, intensity of the magnetic force generated by the magnet 160 may be adjusted to restrain the mass 141 such that at least one mass 141 received in the groove 150 is not separated from the groove 150 in a case in which the number of rotations per minute of the drum 30 is between 0 and 200 rpm and such that the mass 141 is separated from the groove 150 in a case in which the number of rotations per minute of the drum 30 exceeds 200 rpm. When the number of rotations per minute of the drum 30 is less than 200 rpm, intensity of the magnetic force generated by the magnet 160 is greater than that of the centrifugal force applied to the mass 141. When the number of rotations per minute of the drum 30 exceeds 200 rpm, intensity of the magnetic force generated by the magnet 160 is less than that of the centrifugal force applied to the mass 141. When the number of rotations per minute of the drum 30 is 200 rpm, intensity of the magnetic force generated by the magnet 160 is equal to that of the centrifugal force applied to the mass 141.

Intensity of the magnetic force generated by the magnet 160 may be adjusted to a desired value based on the size of the magnet 160, the number of the magnets 160, a material of the magnet 160, a magnetization mode of the magnet 160, etc.

Hereinafter, other structures in which the magnet 160 is coupled to the rear surface of the balancer housing 110 will be described.

Figure 11:
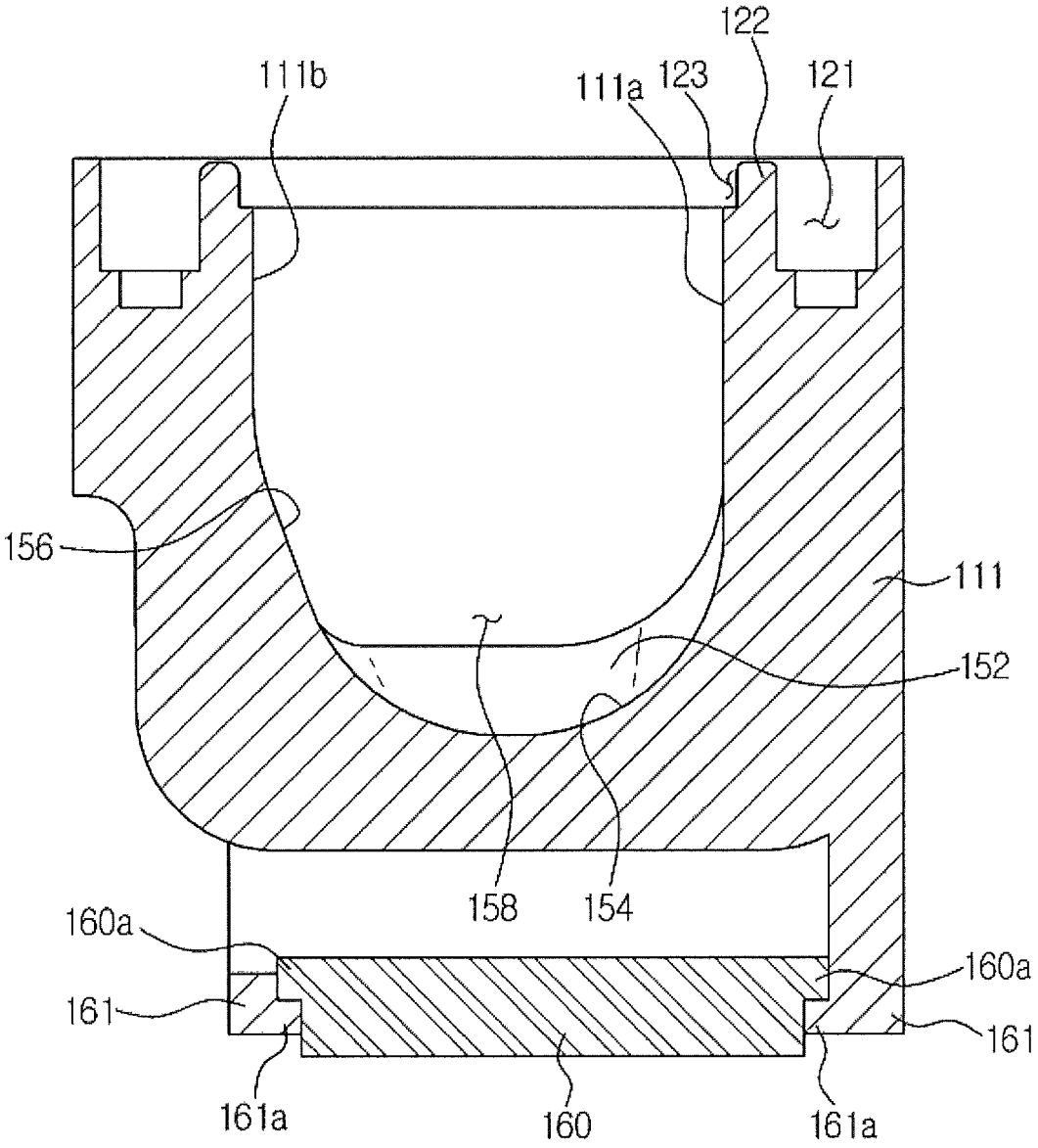
FIG. 11 is a view showing a coupling structure between the balancer housing and the magnet according to another embodiment of the present disclosure.

FIG. 11 is a view showing a coupling structure between the balancer housing and the magnet according to another embodiment of the present disclosure.

As shown in FIG. 11, the balancer housing 110 is provided at the rear surface thereof with a coupling guide 161 to receive the magnet 160 such that the magnet 160 is coupled to the coupling guide 161. The coupling guide 161 includes a plurality of support protrusions 161*a* to couple the magnet 160 in a circumferential direction of the balancer housing 110 and to support the magnet 160 in a state in which the magnet 160 is coupled to the coupling guide 161, thereby preventing the magnet 160 from being separated from the coupling guide 161.

The magnet 160 is provided at the side surface thereof with a stepped part 160*a* supported by the support protrusions 161*a*. The magnet 160 may be coupled and fixed to the balancer housing 110 using an insert injection method in which the magnet 160 is inserted into a mold to manufacture the balancer housing 110 by injection molding.

Figure 12:
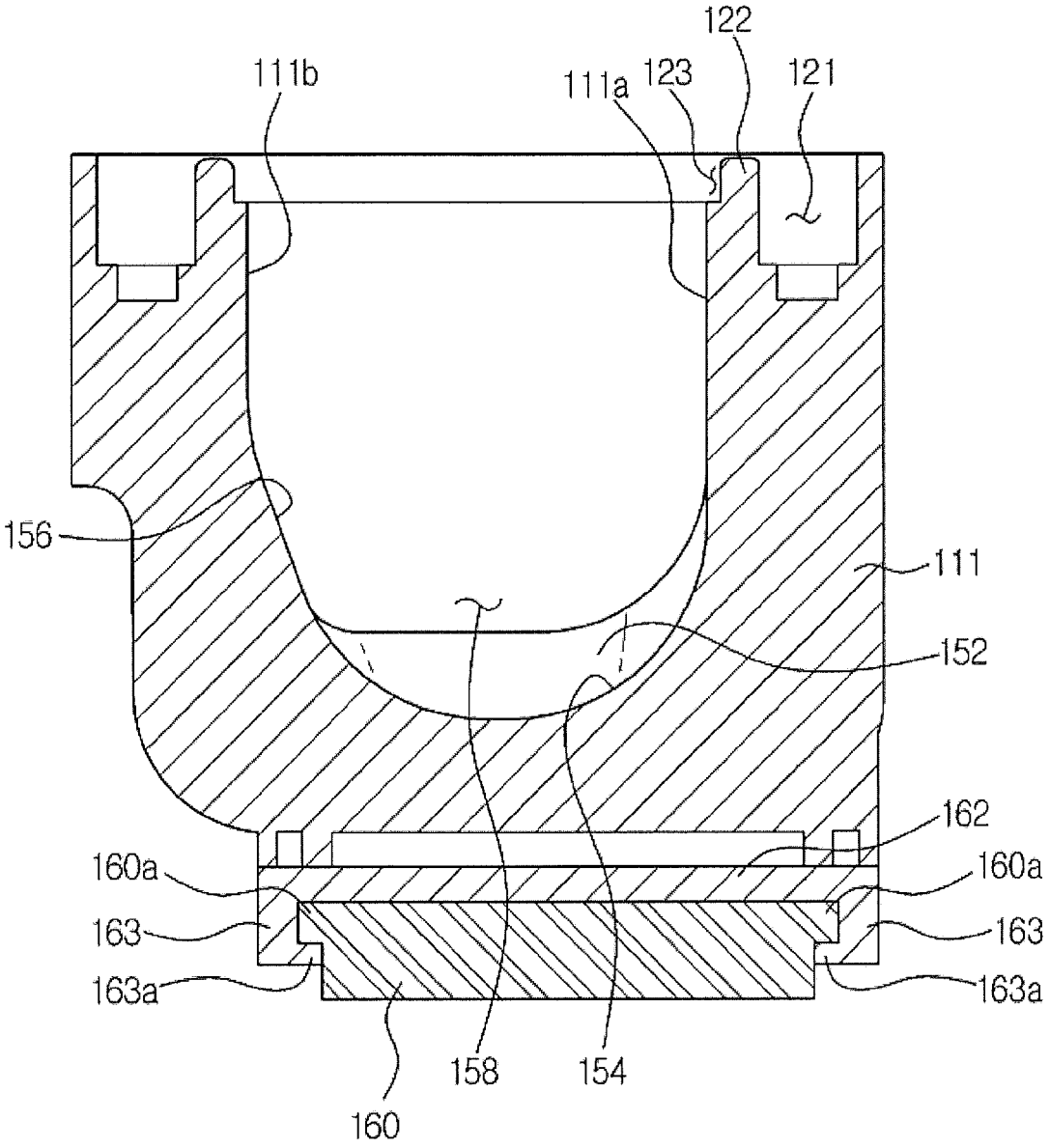
FIG. 12 is a view showing a coupling structure between the balancer housing and the magnet according to another embodiment of the present disclosure.

FIG. 12 is a view showing a coupling structure between the balancer housing and the magnet according to another embodiment of the present disclosure As shown in FIG. 12, the magnet 160 may be coupled to the rear surface of the balancer housing 110 in a state in which the magnet 160 is received in a magnet case 162.

The magnet case 162 is provided at one side thereof with a coupling guide 163 to receive the magnet 160 such that the magnet is coupled to the coupling guide 163. The coupling guide 163 includes a plurality of support protrusions 163*a* to couple the magnet 160 in a circumferential direction of the balancer housing 110 and to support the magnet 160 in a state in which the magnet 160 is coupled to the coupling guide 163, thereby preventing the magnet 160 from separating from the coupling guide 163.

The magnet 160 is provided at the side surface thereof with a stepped part 160*a* supported by the support protrusions 163*a* in a state in which the magnet 160 is coupled to the coupling guide 163. The magnet 160 may be coupled and fixed to the magnet case 162 using an insert injection method in which the magnet 160 is inserted into a mold to manufacture the magnet case 162 by injection molding. The magnet case 162 may be modified according to the shape of the magnet 160.

The magnet case 162 may be fixed to the rear surface of the balancer housing 110 by thermal welding in a state in which the magnet 160 is coupled in the magnet case 162.

One major surface of the magnet 160 may be covered by the magnet case 162 and the other major surface of the magnet 160 may be exposed from the magnet case 162. In this embodiment, the magnet case 162 may be mounted to the rear surface of the balancer housing 110 such that the other major surface of the magnet 160 may be exposed to the rear of the balancer housing 110. The exposed major surface of the magnet 160 may be opposite the front plate 32 of the drum 30.

Figure 13:
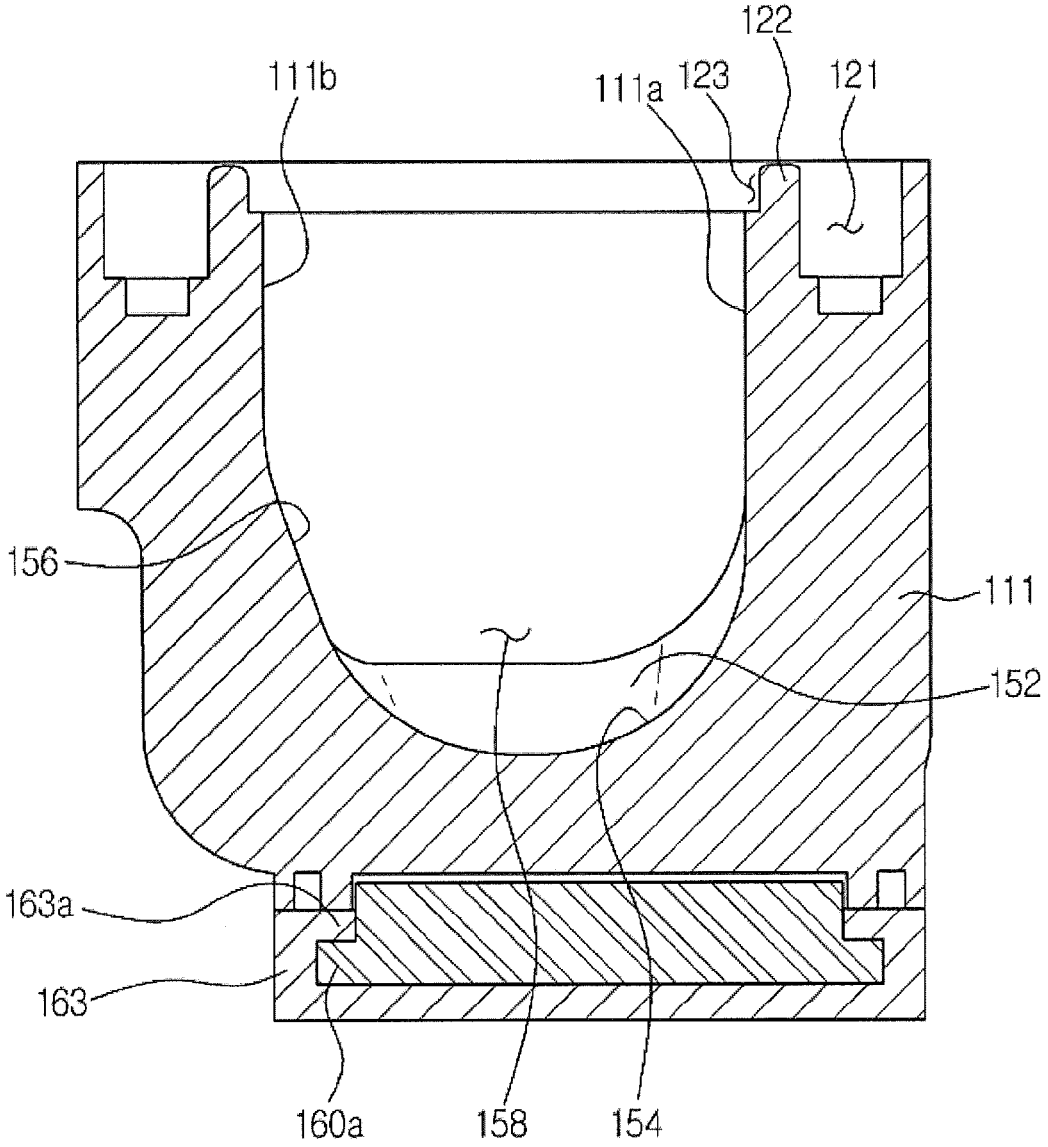
FIG. 13 is a view showing a coupling structure between the balancer housing and the magnet according to another embodiment of the present disclosure.

FIG. 13 is a view showing a coupling structure between the balancer housing and the magnet according to another embodiment of the present disclosure.

Referring to FIG. 13, the magnet 160 may be coupled to the rear surface of the balancer housing 110 in a state in which the magnet 160 is received in a magnet case 162. Similarly to the embodiment of FIG. 12, the magnet 160 may be received in the magnet case 162.

Specifically, the magnet case 162 is provided at one side thereof with a coupling guide 163 to receive the magnet 160 such that the magnet 160 is coupled to the coupling guide 163. The coupling guide 163 includes a plurality of support protrusions 163*a* to couple the magnet 160 in a circumferential direction of the balancer housing 110 and to support the magnet 160 in a state in which the magnet 160 is coupled to the coupling guide 163, thereby preventing the magnet 160 from separating from the coupling guide 163.

The magnet 160 is provided at the side surface thereof with a stepped part 160*a* supported by the support protrusions 163*a* in a state in which the magnet 160 is coupled to the coupling guide 163. The magnet 160 may be coupled and fixed to the magnet case 162 using an insert injection method in which the magnet 160 is inserted into a mold to manufacture the magnet case 162 by injection molding. The magnet case 162 may be modified according to the shape of the magnet 160.

The magnet case 162 may be fixed to the rear surface of the balancer housing 110 by thermal welding in a state in which the magnet 160 is coupled in the magnet case 162.

One major surface of the magnet 160 may be covered by the magnet case 162 and the other major surface of the magnet 160 may be exposed from the magnet case 162. That is, the magnet case 162 may be provided at one side thereof with an opening, through which a portion of the magnet 160 is exposed.

In this embodiment, the magnet case 162 may be mounted to the rear surface of the balancer housing 110 such that the magnet case 162 covering one major surface of the magnet 160 is directed to the rear of the balancer housing 110. The exposed major surface of the magnet 160 may be fixed in a state in which the exposed major surface of the magnet 160 faces or contacts the rear surface of the balancer housing 110.

Since the magnet case 162 does not fully cover the magnet 160 as described above, the volume of the balancer 100 may be minimized. As a result, the capacity of the drum 30 may be maximized. In the embodiment of FIG. 12 or this embodiment, since the magnet 160 is mounted to the balancer housing 110 in a state in which the magnet 160 is received in the magnet case 162, the structure of a mold to manufacture the balancer 100 is simplified and work efficiency is improved during assembly of the balancer 100.

Figure 14:
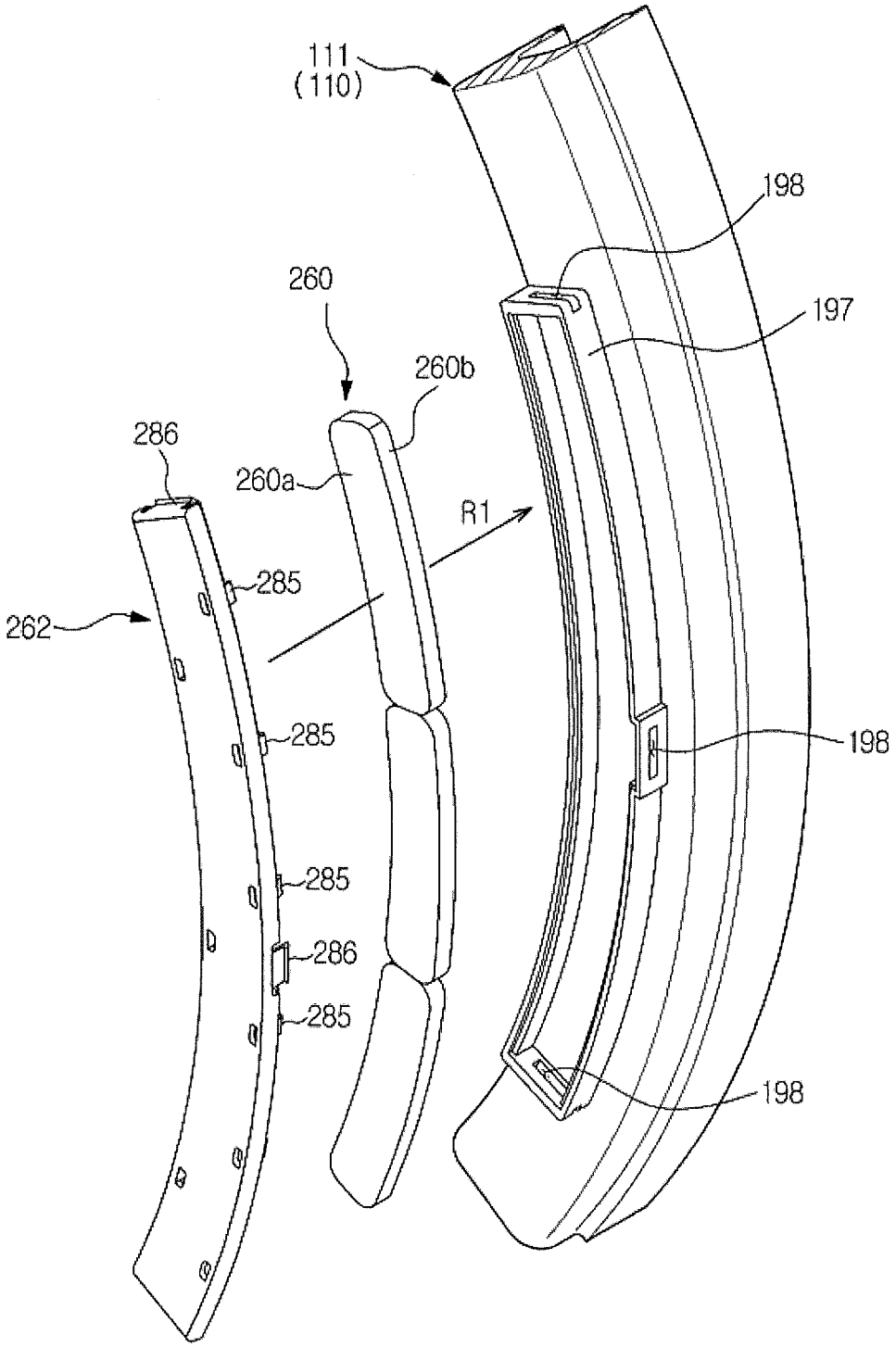
FIG. 14 is a view showing a coupling structure between the balancer housing and the magnet according to a further embodiment of the present disclosure.
Figure 15:
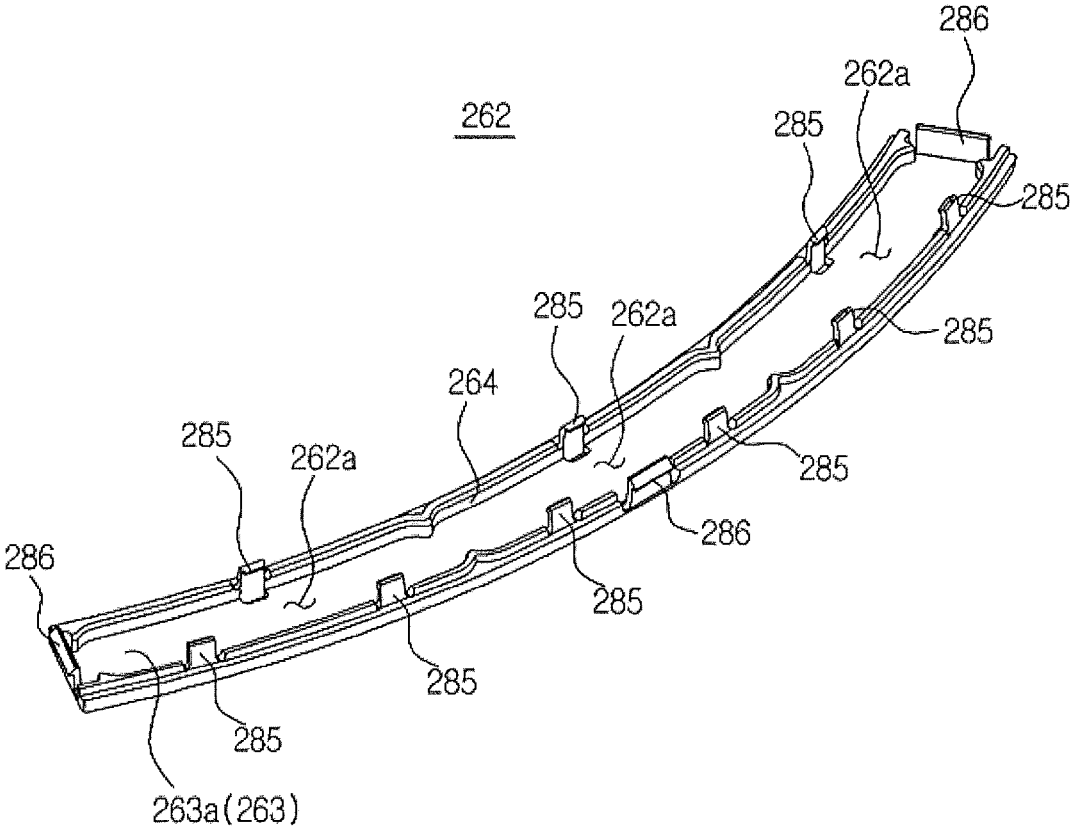
FIG. 15 is a view showing a magnet case.
Figure 16:
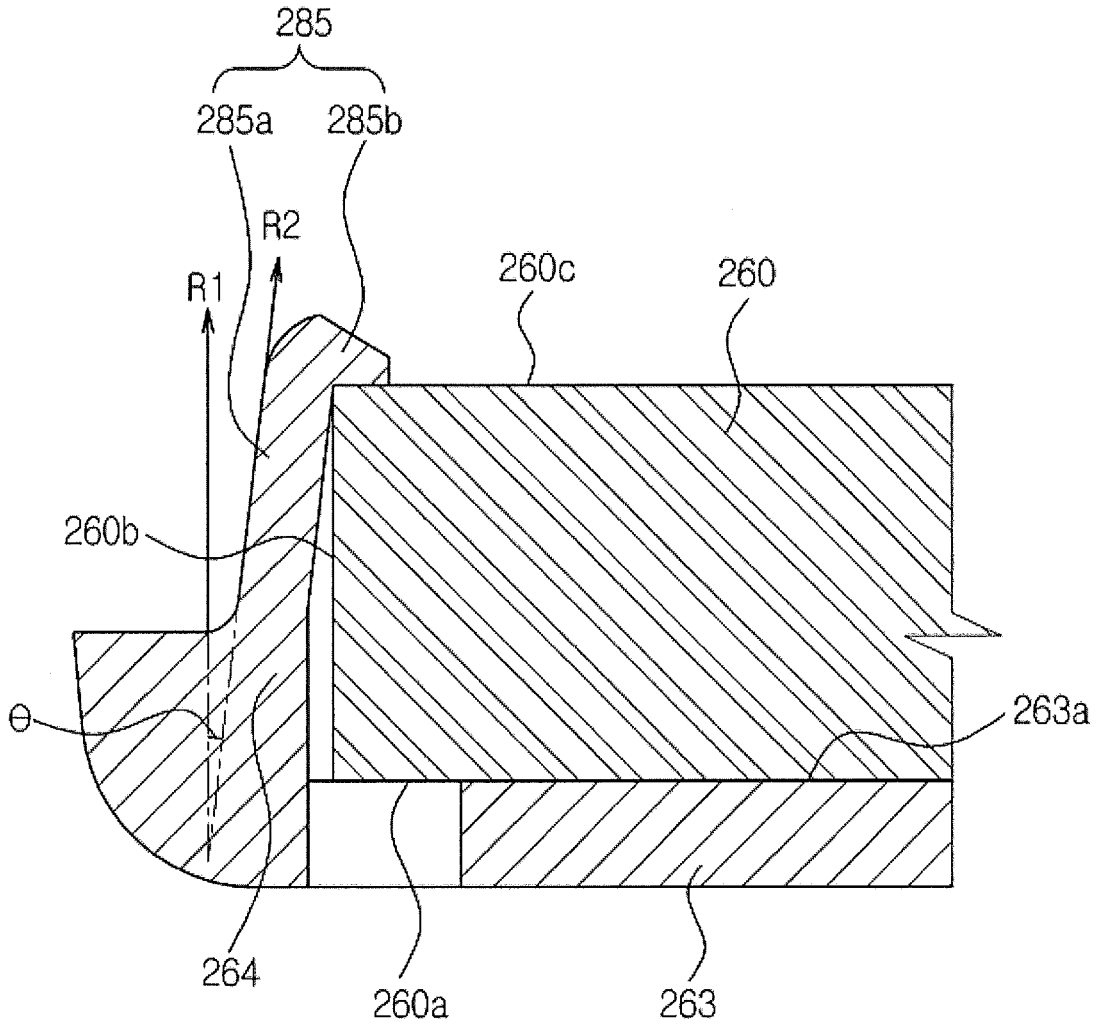
FIGS. 16 and 17 are views showing a coupling structure between a magnet and a magnet fixing hook.
Figure 17:
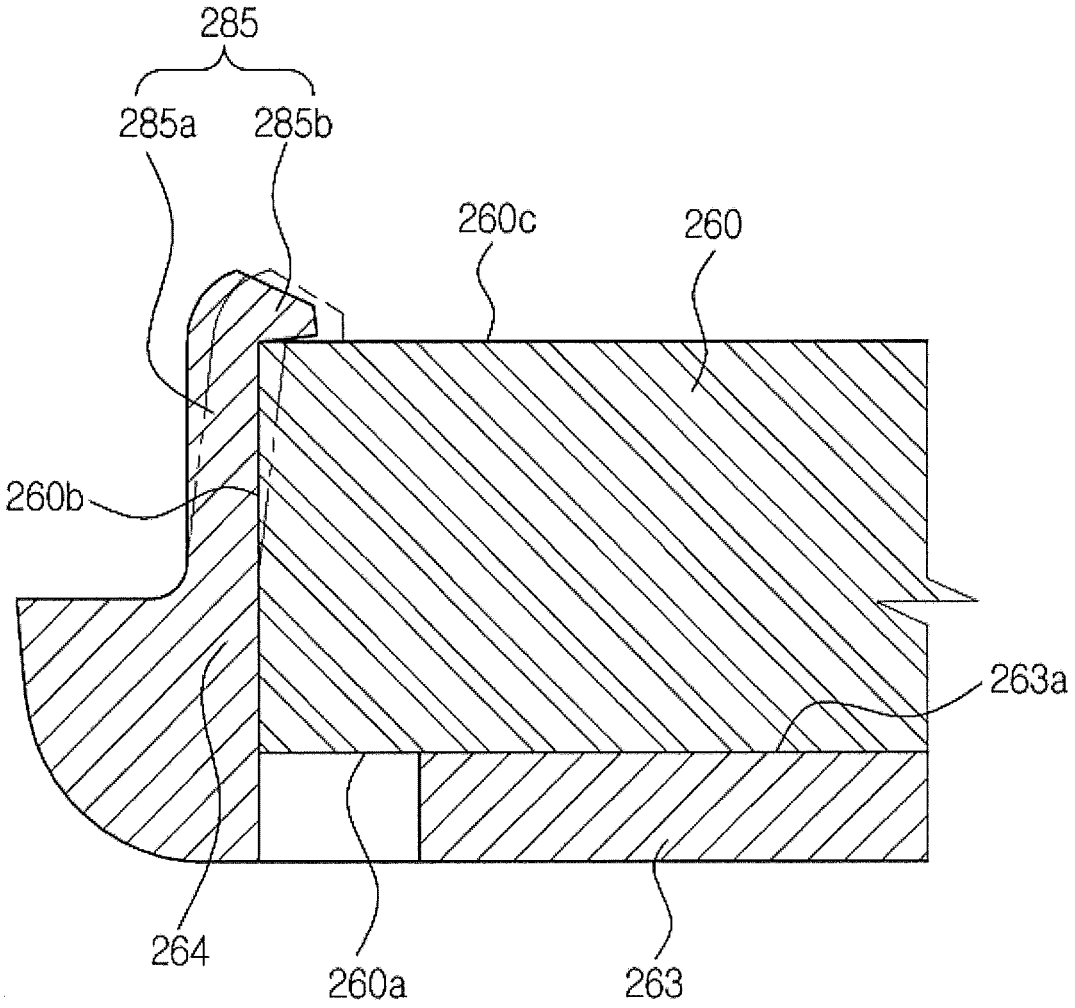
Figure 18:
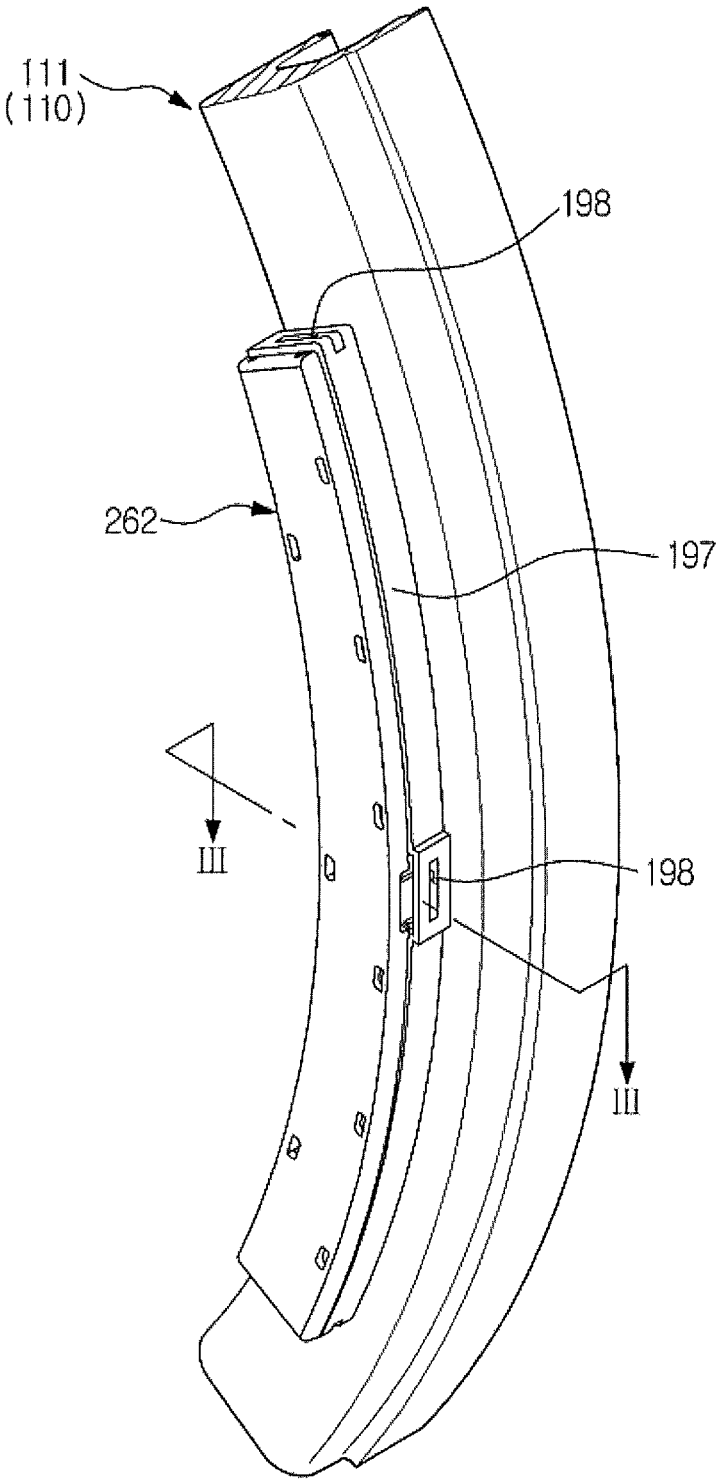
FIG. 18 is a view showing a state in which the magnet case is coupled to the balancer housing.
Figure 19:
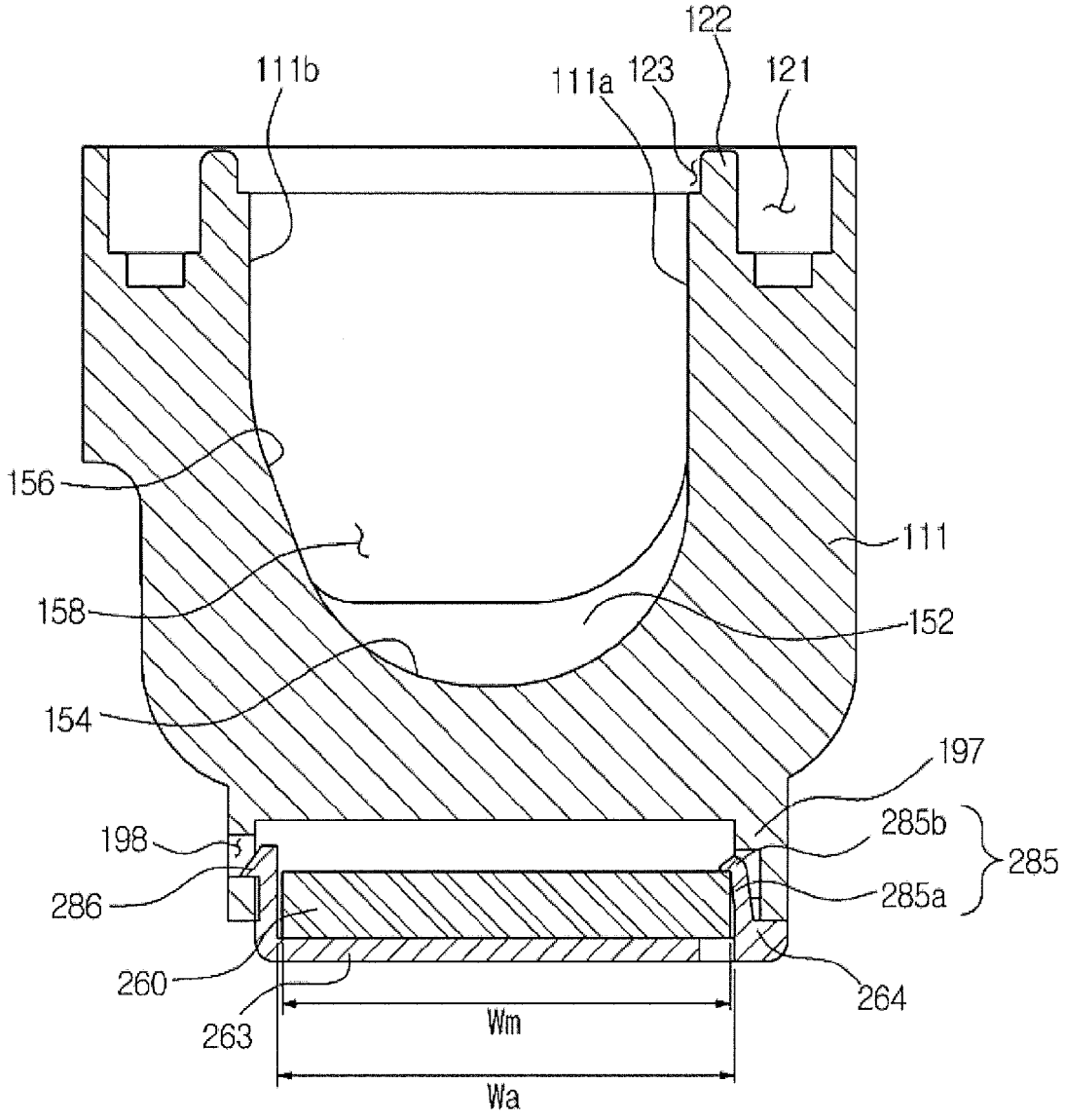
FIG. 19 is a sectional view taken along line III-Ill of FIG. 18.

FIG. 14 is a view showing a coupling structure between the balancer housing and the magnet according to a further embodiment of the present disclosure, FIG. 15 is a view showing a magnet case, FIGS. 16 and 17 are views showing a coupling structure between a magnet and a magnet fixing hook, FIG. 18 is a view showing a state in which the magnet case is coupled to the balancer housing, and FIG. 19 is a sectional view taken along line of FIG. 18.

As shown in FIGS. 14 to 19, a magnet case 262 is coupled to the rear surface of the balancer housing 110 at the rear of the balancer housing 110 in a direction in which the balancer housing 110 is coupled to the recess 38.

The magnet case 262 includes a plurality of magnet receiving parts 262*a* to receive magnets 260, a first support part 263 and a second support part 264 to support the magnets 260 received in the magnet receiving parts 262*a*, a plurality of magnet fixing hooks 285 to fix the magnets 260 received in the magnet receiving parts 262*a*, and a plurality of case fixing hooks 286 to fix the magnet case 262 to the rear surface of the balancer housing 110 in a state in which the magnets 260 are received and fixed in the magnet receiving parts 262*a*.

The magnet receiving parts 262*a* are provided in shapes corresponding to the magnet 260. At least two magnet receiving parts 262*a* are arranged in a circumferential direction of the balancer housing 110.

The first support part 263 constitutes the magnet receiving parts 262*a* and supports one major surface 260*a* of each of the magnets 260 received in the magnet receiving parts 262*a*. The second support part 264 constitutes the magnet receiving parts 262*a* together with the first support part 263 and supports a side surface 260*b* of each of the magnets 260 received in the magnet receiving parts 262*a*.

The first support part 263 includes a support surface 263*a* formed in an arc shape to support one major surface 260*a* of each of the magnets 260. The second support part 264 protrudes from the support surface 263*a* of the first support part 263 and is formed in a shape surrounding the side surface 260*b* of each of the magnets 260.

The magnet fixing hooks 285 are arranged along the second support part 264 at intervals to uniformly fix the magnets 260 received in the magnet receiving parts 262*a*.

Each magnet fixing hook 285 includes an extension part 285*a* extending from the second support part 264 at an angle to a direction R1 in which the magnet case 262 is coupled to the balancer housing 110 and a hook part 285*b* provided at one end of the extension part 285*a* to support the other major surface 260*c* of each of the magnets 260 opposite to one major surface 260*a* of each of the magnets 260.

In a radial direction of the balancer housing 110, a width Wm of each magnet 260 may be equal to a width Wa of each magnet receiving part 262*a*. During actual production of the magnets 260, however, the width Wm of each magnet 260 may be changed within a tolerance range. That is, the width Wm of each magnet 260 which has been actually produced may be less or greater than a design value within an allowable range.

If the width Wm of each magnet 260 is less than the design value within the tolerance range, the contact area between the hook part 285*b* of each magnet fixing hook 285 and the other major surface 260*c* of each magnet 260 is small with the result that the magnets 260 may be separated from the magnet receiving parts 262*a* during rotation of the drum 30. On the other hand, if the width Wm of each magnet 260 is greater than the design value with the tolerance range, the magnets 260 may not be received in the magnet receiving parts 262*a*.

In a case in which the width Wa of each magnet receiving part 262*a* is equal to the maximum value of the width Wm of each magnet 260 within the tolerance range and the magnet fixing hooks 285 extend to the magnets 260 received in the magnet receiving parts 262*a* at an angle to the direction R1 in which the magnet case 262 is coupled to the balancer housing 110, the magnet fixing hooks 285 may stably support the magnets 260 even when the width Wm of each magnet 260 is changed within the tolerance range.

As described above, the magnet fixing hooks 285 extend to the magnets 260 received in the magnet receiving parts 262*a* at an angle to the direction R1 in which the magnet case 262 is coupled to the balancer housing 110. Even in a case in which the width Wm of each magnet 260 has a minimum value within the tolerance range as shown in FIG. 16, therefore, the contact area between the hook part 285*b* of each magnet fixing hook 285 and the other major surface 260*c* of each magnet 260 is secured with the result that the magnets 260 are stably supported.

In addition, the width Wa of each magnet receiving part 262*a* is equal to the maximum value of the width Wm of each magnet 260 within the tolerance range. Even in a case in which the width Wm of each magnet 260 has a maximum value within the tolerance range as shown in FIG. 17, therefore, the magnets 260 are received in the magnet receiving parts 262*a*. During reception of the magnets 260 in the magnet receiving parts 262*a*, the magnet fixing hooks 285 are deformed approximately in parallel to the direction R1 in which the magnet case 262 is coupled to the balancer housing 110 and then contact the side surfaces 260*b* of the magnets 260 due to shape restoring force to more securely support the magnets 260.

An inclination angle θ between the direction R1 in which the magnet case 262 is coupled to the balancer housing 110 and a direction R2 in which each magnet fixing hook 285 extends from the second support part 264 may be 0.4 to 0.6 degrees.

If the inclination angle θ is less than 0.4 degrees, the contact area between the hook part 285*b* of each magnet fixing hook 285 and the other major surface 260*c* of each magnet 260 is small with the result that sufficient supporting force is not secured. During rotation of the drum 30, therefore, the magnets 260 may be separated from the magnet receiving parts 262*a*.

If the inclination angle θ is greater than 0.6 degrees, the magnets 260 may not be received in the magnet receiving parts 262*a* or, when the magnets 260 are forcibly received in the magnet receiving parts 262*a*, the magnet fixing hooks 285 may be damaged.

The case fixing hooks 286 extend from the support surface 263*a* of the first support part 263 in the direction R1 in which the magnet case 262 is coupled to the balancer housing 110.

The balancer housing 110 includes a magnet case receiving part 197 protruding from the rear surface of the balancer housing 110 in a shape corresponding to the external shape of the magnet case 262 to receive at least a portion of the magnet case 262 and a plurality of catching holes 198 formed through the magnet case receiving part 197 to catch the case fixing hooks 286.

The case fixing hooks 286 are coupled in the catching holes 198 to prevent the magnet case 262 from being separated from the balancer housing 110.

As is apparent from the above description, the balancer effectively offsets unbalanced load applied to the drum, thereby stabilizing rotation of the drum. In addition, the magnet case, in which the magnets are mounted, is separately provided and mounted to the balancer housing. Consequently, the structure of a mold for the balancer is simplified and manufacturing efficiency is improved during assembly of the balancer.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:
a cabinet;
a drum rotatably disposed in the cabinet; and
a balancer mounted to the drum to offset unbalanced load generated in the drum during rotation of the drum,
wherein the balancer comprises
a balancer housing having an annular channel defined therein;
at least one mass movably disposed in the channel;
a magnet provided at one side of the balancer housing to restrain the mass; and
a magnet case to receive the magnet,
wherein the magnet case covers one major surface of the magnet and exposes the other major surface of the magnet, and
the other major surface of the magnet exposed from the magnet case is opposite the drum toward a rear of the balancer housing.

2. The washing machine according to claim 1, wherein the magnet case is coupled to a rear surface of the balancer housing in a state in which the magnet is received in the magnet case.

3. The washing machine according to claim 1, wherein the magnet is disposed in a circumferential direction of the balancer housing to restrain the mass when the number of rotations per minute of the drum is within a predetermined range.

4. The washing machine according to claim 1, wherein the magnet case is provided with a plurality of support protrusions to prevent the magnet from being separated from the magnet case.

5. The washing machine according to claim 4, wherein the magnet is provided with a stepped part, which is supported by the support protrusions.

6. The washing machine according to claim 1, wherein the magnet case is fixed to a rear surface of the balancer housing by thermal welding in a state in which the magnet is received in the magnet case.

7. The washing machine according to claim 1, wherein the magnet comprises a plurality of magnets, which are received in the magnet case.

8. The washing machine according to claim 1, wherein the magnet is coupled to the magnet case by insert injection.

9. The washing machine according to claim 1, wherein the drum is provided with an annular recess, in which the balancer is mounted.

10. The washing machine according to claim 1, wherein a damping fluid to push the mass when force is applied to the mass is contained in the channel.

11. A balancer of a washing machine to offset unbalanced load present in a drum of the washing machine, the balancer comprising:
a balancer housing mounted to at least one selected from a front surface and a rear surface of the drum, the balancer housing having a channel extending in a circumferential direction of the drum;
a plurality of masses movably disposed in the channel;
a magnet formed at an inner surface of the balancer housing to restrain the masses when the number of rotations per minute of the drum is within a predetermined range; and
a magnet case to receive the magnet, wherein the magnet case is provided at one side thereof with an opening through which a major surface of the magnet is exposed opposite the drum toward a rear of the balancer housing.

12. The balancer according to claim 11, wherein the magnet case is provided at one side thereof with a support protrusion to prevent the magnet from being separated from the magnet case.

13. The balancer according to claim 12, wherein the magnet is provided with a stepped part, which is supported by the support protrusion.

14. The balancer according to claim 11, wherein the magnet is coupled to the magnet case by insert injection.

15. The balancer according to claim 11, wherein the magnet comprises a plurality of magnets, which are received in the magnet case.

16. The balancer according to claim 11, wherein the magnet case is fixed to a rear surface of the balancer housing in a state in which the magnet is received in the magnet case.

* * * * *